US007117579B2

(12) United States Patent
Schellenberg

(10) Patent No.: US 7,117,579 B2
(45) Date of Patent: Oct. 10, 2006

(54) METHOD FOR PRODUCING A COMBINED PACKING CONTAINER AND A DEVICE FOR CARRYING OUT SAID METHOD

(75) Inventor: Walter Schellenberg, Diepoldsau (CH)

(73) Assignee: Rundpack AG, Diepoldsau (CH)

( * ) Notice: Subject to any disclaimer, the term of this patent is extended or adjusted under 35 U.S.C. 154(b) by 160 days.

(21) Appl. No.: 10/472,103

(22) PCT Filed: Jan. 10, 2003

(86) PCT No.: PCT/EP03/00174

§ 371 (c)(1),
(2), (4) Date: Mar. 24, 2004

(87) PCT Pub. No.: WO03/057577

PCT Pub. Date: Jul. 17, 2003

(65) Prior Publication Data

US 2004/0154156 A1 Aug. 12, 2004

(30) Foreign Application Priority Data

Jan. 10, 2002 (CH) ..... 35/02

(51) Int. Cl.
*B21D 39/00* (2006.01)
*B21D 39/03* (2006.01)
*B31B 1/60* (2006.01)

(52) U.S. Cl. ..... 29/521; 29/505; 29/430; 493/84

(58) Field of Classification Search ..... 29/430, 29/428, 431, 521, 505; 493/84, 89, 121, 493/108, 51; 229/45; 206/515
See application file for complete search history.

(56) References Cited

U.S. PATENT DOCUMENTS 4,007,670 A 2/1977 Albano et al.

FOREIGN PATENT DOCUMENTS

| | | |
|---|---|---|
| CH | 690431 | 9/2000 |
| WO | WO9813270 | 4/1998 |

*Primary Examiner*—John C. Hong
(74) *Attorney, Agent, or Firm*—Collard & Roe, P.C.

(57) ABSTRACT

As part of a method for producing a combination packaging container (28), which combination packaging container (28) comprises a beaker-shaped plastic inner part (15) and a casing-type outer part (14) surrounding the plastic inner part (15) and retained on the external face of the plastic inner part (15) in an interlocking arrangement, and by which method the two parts (14, 15) are pushed one in the other in an interlocking arrangement, the assembly process is improved due to the fact that the outer part (14) is retained in a holder (13) and the plastic inner part (15) is introduced into the outer part (14) retained in the holder (13) and then pushed down into the outer part (14) so as to interlock.

37 Claims, 7 Drawing Sheets

METHOD FOR PRODUCING A COMBINED PACKING CONTAINER AND A DEVICE FOR CARRYING OUT SAID METHOD

CROSS REFERENCE TO RELATED APPLICATIONS

Applicants claim priority under 35 U.S.C. 119 of SWITZERLAND Application No. 35/02 filed on Jan. 10, 2002. Applicants also claim priority under 35 U.S.C. § 365 of PCT/EP03/00174 filed on Jan. 10, 2003. The international application under PCT article 21(2) was not published in English.

FIELD OF THE INVENTION

The present invention falls within the field of packaging technology. It relates to a method of producing a combination packaging container of the type outlined in the generic part of claim 1 and a device for implementing the method.

THE PRIOR ART

A combination packaging container is known from an earlier patent application, WO 98/13270 A1, filed by the present applicant, in which a beaker-shaped plastic inner part and a casing-type outer part (e.g. made from cardboard) are initially made separately and then inserted one inside the other and interlocked with one another to form the final container. The process of making the interlocked connection is problematic because the relatively thin-walled plastic inner part is susceptible to deformation. The deformation is caused by a bead of extra material on the base of the plastic inner part, past which the outer part, which becomes narrower at the bottom, has to be pushed in order to lock underneath it.

With the assembly method used to date, the prefabricated outer part is gripped by a clamp and pushed onto the plastic inner part, which is retained in a holder. However, this approach is not without problems. Firstly, a moving gripper clamp is complicated in structure and susceptible to faults.

Furthermore, the image printed on the external face of the outer part, which is generally of a high quality, can easily be damaged during the gripping process. Secondly, the assembly process can be operated at relatively limited rates only if using a gripper clamp, which means that several identical stations have to be operated in parallel to obtain a high throughput, which is expensive.

DESCRIPTION OF THE INVENTION

Accordingly, the objective of the invention is to propose a method for producing combination packaging containers joined in an interlocked arrangement, which can be operated reliably but with less machinery, whilst simultaneously enabling a high throughput rate with a high degree of operating reliability, as well as a system for implementing this method.

This objective is achieved as a result of all the features outlined in claims 1 and 21. The essential aspect of the invention is based on the fact that the outer part is held in a holder and the plastic inner part is firstly introduced into the outer part retained in the holder, in particular is loosely inserted in it, and the outer part is then pushed in so that it interlocks, the plastic inner part and the outer part preferably being of a conical shape, tapering towards the base—in other words towards the bottom as seen in the normal position of usage. Consequently, depending on the selected assembly position, the plastic inner part can be inserted in the outer part from above or from underneath, for example.

Another advantageous approach is one whereby the plastic inner part is loosely inserted in the outer part retained in a holder at a first station and the loosely inserted plastic inner part is then pushed into and interlocked with the outer part at a second station. This enables the production line to be operated at an even higher rate because the insertion process and the subsequent interlocking process are operated at different work stations.

One particularly preferred approach to operating the method is characterised by the fact that the motion whereby the plastic inner part is pushed down into the outer part takes place at the same station as that at which the plastic inner part is inserted in the outer part. This obviates the need for an additional station, thereby saving on the cost of machinery.

It is also of advantage if, at the same time as the plastic inner part is introduced into the outer part retained in the holder, the outer part is moved relative to the plastic inner part and in the opposite direction, because although the absolute speed of the motion is slower, the parts are moved towards one another at the same relative speed of motion over shorter distances during the joining process so that the timing is not adversely affected.

A preferred embodiment of the method proposed by the invention is characterised by the fact that the plastic inner part has an essentially flat base and the plastic inner part is held by the base as it is loosely introduced into the outer part, for which purpose the plastic inner part is preferably releasably retained at the external face of the base by a holding mechanism extending through the outer part from underneath and pulled into the outer part. This being the case, the plastic inner part is releasably retained by the holding mechanism by means of a suction cup. This provides a reliable driving link between the plastic inner part and the holding mechanism during the inserting motion, which primarily ensure that the plastic inner part is correctly pre-positioned inside the outer part.

Another advantage is obtained by this method if catch means are provided on the plastic inner part for retaining and interlocking the plastic inner part and outer part, and these means are provided in the form of a first catch means in the region of the open end face of the plastic inner part constituting the sealing lip and another catch means is provided in the region of the base in the form of at least one bead extending around at least certain parts of the circumference of the plastic inner part. It is of particular advantage to provide the bead so that it extends continuously around the circumference of the plastic inner part. The outer part will then provide a support function for the plastic inner part so that relatively high axial stacking forces can be introduced into the combination packaging without damaging the plastic inner part, thereby preventing whatever contents are placed in its interior from inadvertently leaking out and spoiling due to higher exposure to air.

Another preferred embodiment of the method proposed by the invention is characterised in that before and during the process of pushing the plastic inner part into the outer part, an external circumference of the other catch means is reduced by deforming the base by a predeterminable amount to the degree that it essentially corresponds to an internal diameter of the outer part in the area of the smaller dimension and can be pushed fully into the outer part with significantly less resistance. By making the outer circumference or periphery of the catch means smaller, the plastic inner part can be more easily pushed past the smallest internal dimension of the outer part and deformed by a predefinable degree without causing any damage to the plastic inner part. As a result of the predefinable amount of deformation, which mostly occurs in the base, any detrimental deformation and damage to the plastic inner part which might otherwise occur in this region is avoided.

Another advantageous approach to the method is obtained if, as it is pushed in, the base is resiliently collapsed inwards towards an interior of the plastic inner part by a force acting on it in a predetermined manner. This predefinable force can be applied by means of a separate ram and/or by generating a vacuum pressure in the region of the interior of the plastic inner part. This will also induce a predefinable deformation of the plastic inner part in the region of the base, thereby reducing the external circumference of the other catch means to the degree that the insertion and pushing-down process can be operated without having to apply strong force and with significantly reduced resistance.

It is also of advantage if the outer part is retained in the holder with its largest internal dimension downwards and if the plastic inner part and outer part are conical design, tapering towards the base, and the plastic inner part is inserted in the outer part from underneath. This provides an easy means of pre-positioning the plastic inner part on an insertion element so that the two parts can be interlocked with one another without having to preposition the plastic inner part in the outer part.

One particularly preferred embodiment of the method proposed by the invention is characterised by the fact that, during the process of inserting the plastic inner part at the second station, a force is applied to the plastic inner part simultaneously at its top edge and in the region of the base, acting in the insertion direction. This reliably prevents any undesirable deformation and collapse of the plastic inner part. A perfect and reliable interlock is obtained if a circumferential bead is provided in the region of the base for interlocking the plastic inner part and outer part and if the base is resiliently collapse outwards in a predefined manner by the insertion force acting on it during insertion.

As an alternative to the above, however, the objective is achieved by the invention as a result of a system with a holder for retaining the outer part and a first station for pushing the plastic inner part so that it interlocks with the outer part retained in the holder. The holder retains and pre-positions the outer part in a predefined position or location and the plastic inner part is then pushed into and interlocks. This provides a simple means of assembling the combination packaging container to form a unit.

A preferred embodiment of the system proposed by the invention is characterised by the fact that the plastic inner part and outer part are of a conical design, tapering towards the base—in other words as viewed in the normal position of usage—and the holder has a retaining ring with an internal contour which is conical and tapers towards the bottom, in which the outer part can be held clamped.

The outer part is reliably protected from damage if the internal contour of the bottom section of the retaining ring with the conically tapering shape is adapted to the shape of the outer part, whilst the internal contour above the bottom section becomes increasingly wider in diameter, and the retaining ring is made from a dimensionally stable material with a low sliding friction, in particular a plastic material, preferably an acetal homopolymer (polyoxymethylene POM).

One feature which ensures careful handling of the parts is the fact that the first station has a ram which is mounted so as to slide in the insertion direction and applies a force in the insertion direction in order to introduce and interlock the plastic inner part in the outer part, the ram being designed so that it applies a force both to the base and to the top rim of the plastic inner part during the insertion process.

It has proved to be particularly effective if the ram has a flange-type upper part which is placed on the top rim of the plastic inner part, and this is adjoined in the insertion direction by a plunger-type bottom part which is placed against the base of the plastic inner part, the distance between the bottom face of the top part and the bottom face of the bottom part of the ram preferably being a few millimetres bigger, preferably approximately 5 mm bigger, than the distance between the top rim and the base of the plastic inner part.

Vastly improved handling of the parts is achieved due to the fact that the ram at the first station is moved in the insertion direction by displaceable drive means and the drive means engage with the ram via a spring.

Another possible option is to provide a second station upstream of the first station, in which the plastic inner part is loosely inserted in the outer part retained in the holder and the second station is provided with holding and conveying means which releasably hold the plastic inner part and convey it from a conveying and feed mechanism into the outer part retained in the holder. It is of particular advantage to provide the holding means with a suction cup and the conveying means with a rod system, displaceable in the insertion direction by means of pneumatic cylinder, which extends through the outer part retained in the holder. As a result, an assembly station or insertion station is provided separately from the pushing-in station and the plastic inner part is pushed into the outer part separately from it in a simple manner. Providing work stations separate from one another at two different locations means, firstly, that the timing rate can be increased and, secondly, that the final assembly process can be operated with less susceptibility to problems.

In other embodiments, advantage is to be had if the plastic inner part and the outer part are of a conical design, tapering towards the base, and the holder has a retaining ring with a conically tapered internal contour with the taper converging towards the top as viewed in the vertical direction. It is also of advantage if the internal contour of the retaining ring matches a top section of the conically tapered shape of the outer part and the internal contour underneath the top section becomes increasingly wider in diameter. As a result, the outer part can be readily placed in a holder and will sit perfectly because of the tapering internal contour, thereby fixing the position of the outer part relative to the holder.

In another advantageous embodiment, the holder for retaining the outer part is provided with retaining means, which reliably prevents the outer part from being inadvertently released from the holder.

Another alternative is an arrangement in which the plastic inner part co-operates with an insertion element for inserting and/or pushing it into the outer part, which projects partially into the interior of the plastic inner part, and the cross section of the insertion element matches the internal dimensions of the plastic inner part. This firstly ensures that the plastic inner part is exactly positioned in the axial direction relative to the outer part. Secondly, because the external surface of the insertion element matches the internal dimensions of the plastic inner part, the plastic inner part is well supported with the appropriate tolerance on the insertion element, which sits flat and tightly against the inside wall of the plastic inner part.

However, another possibility is to provide at least one suction line in the insertion element, which opens into the free space or intermediate space left between the base of the plastic inner part and the insertion element, the suction line being connected to a vacuum generator. Consequently, when a vacuum pressure is generated accordingly, the base region of the plastic inner part is drawn in and collapses towards its interior, which enables the external cross-sectional dimension of the catch means to be reduced to the degree that the plastic inner part can be pushed in and down past the narrowest diameter or dimension of the outer part with only a light pushing action.

Finally, it would also be possible for the suction line to project beyond the insertion element and extend to a predefinable distance short of the base of the plastic inner part, making it easy to fix a predeterminable amount by which the base can be drawn in, whilst the fact that the suction line serves as a stop as the base is sucked onto also helps to fix its position in the axial direction.

(Other embodiments are defined in the dependent claims.)

BRIEF DESCRIPTION OF THE DRAWINGS

The invention will be described in more detail below with reference to examples of embodiments illustrated in the appended drawings. Of these.

METHODS OF IMPLEMENTING THE INVENTION

Figure 1:
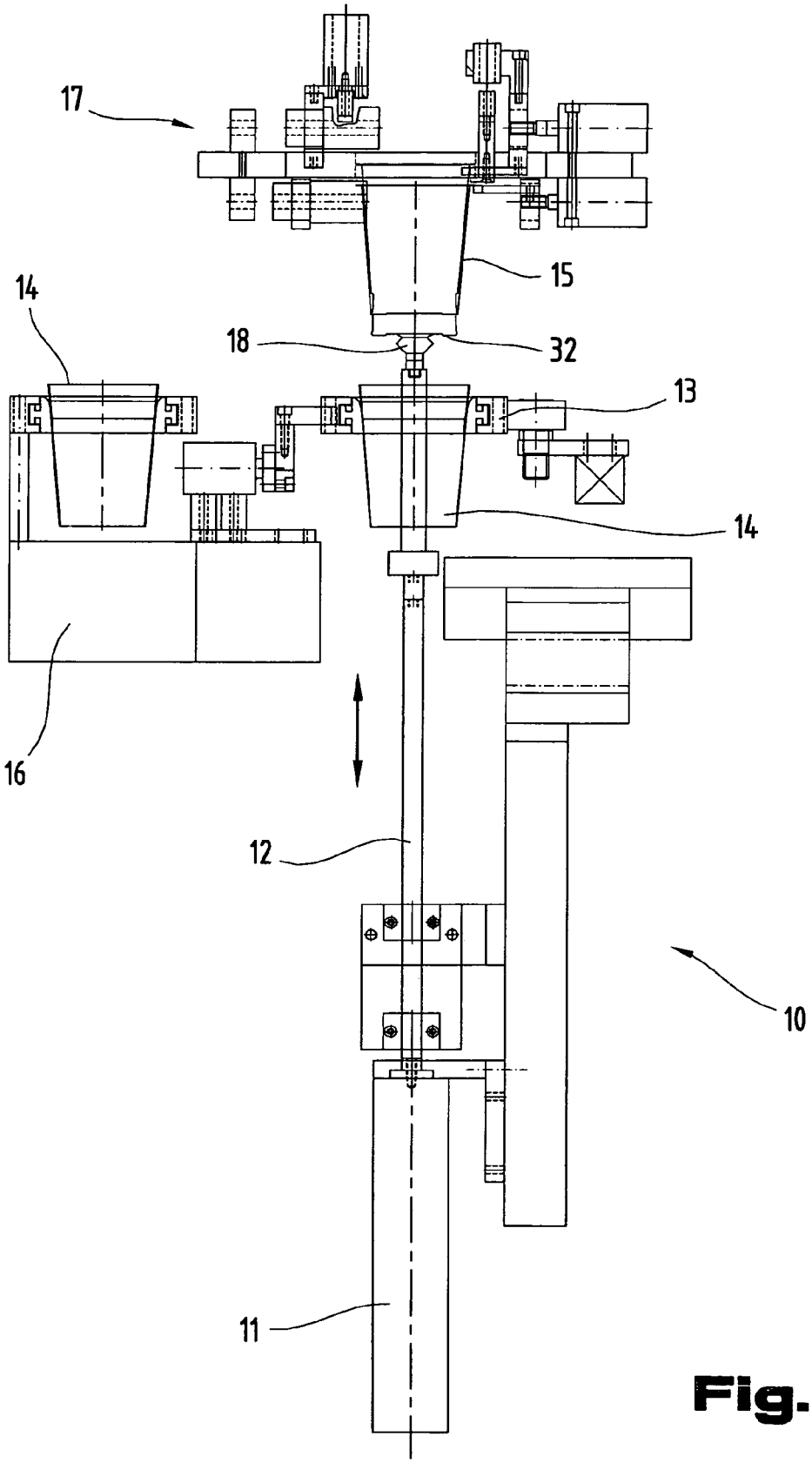
FIG. 1 is a highly simplified side view of a suction station for loosely inserting the plastic inner part in the outer part retained in a holder, in one embodiment of the method proposed by the invention.

The method proposed by the invention relates to a combination packaging container of the type described in detail in earlier applications filed by the present applicant (see patent specification CH 690 431 A5 or WO 98/13270 A1, for example). A combination packaging container of this type, which is suitable for packaging yoghurt or other foodstuffs, is made up of a beaker-shaped plastic inner part and an outer part forming a casing (made from cardboard, for example), which are initially produced separately and then inserted one inside the other to form the finished container and are joined to one another in an interlocking arrangement. The advantage of this composite structure is that it saves on the amount of plastic used for the inner carton without detracting from its strength and once the contents have been used, the packaging can be separated and disposed of separately, and the outer part can be easily and expediently crushed, thereby saving on space. Further details may be found in the earlier applications mentioned above, the disclosures of which explicitly form part of this present application.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

The interlocking connection between the plastic inner part and the cardboard outer part is provided in the area where the parts taper in a conical shape towards the bottom by means of a bead on the outer part disposed between the top rim of the plastic inner part, which serves as a sealing lip, and the base region. When pulled past and beyond the bead, the base bends resiliently, which ensures that a force is applied in the longitudinal direction via the bead, ensuring correct insertion in the relatively rigid outer casing made from cardboard.

In order to join the two parts, namely the plastic inner part 15 and outer part 14, the outer part 14 proposed by the invention is retained in an appropriate holder (13 in FIG. 1, 3 or 5) and the plastic inner part 15 is introduced into the outer part 14 retained in the holder 13, after which the outer part 14 is pushed in so as to interlock. The major part of the holder 13 is a retaining ring 19, which is illustrated in longitudinal section (FIG. 2*a*) and in a plan view from above (FIG. 2*c*) in FIG. 2. The retaining ring 19 is made from a dimensionally stable material with a low sliding friction, in particular a plastic, preferably an acetal homopolymer (polyoxymethylene POM), such as that made by the DuPont company under the Delrin® trade mark, for example. The retaining ring 19 has a special internal contour 20 with a tapered bottom section 21 (FIG. 2*a, b*) matching the conically tapered outer part (14 in FIG. 2*b*) (same angle of inclination as outer part 14). Consequently, the outer part 14 as illustrated in FIG. 2*b*—is held clamped in the retaining ring 19 without being fixed. Accordingly, once it has been joined to the plastic inner part 15 it can easily be taken out of the retaining ring 19 again. Above the bottom section 21, the internal contour 20 widens to an increasing diameter in a funnel shape. This facilitates the task of placing the outer part 14 in the retaining ring 19 at the automatic insertion station, operated at a high speed (10 in FIG. 1), and improves operating reliability. The retaining ring 19 should be at least 20 mm in height in order to ensure that the outer part 14 is held stable and firm. The internal diameter of the retaining ring 19 should be selected so that the outer part 14 sits with at least 10 mm projecting down from the retaining ring 19 so that when the plastic inner part 15 is pressed down, the bead 29 provided in the base region is not damaged.

The plastic inner part 15 is introduced into the outer part 14 retained in the holder 13 at the insertion station 10 mentioned above, which is illustrated in FIG. 1 in a highly simplified format. At the insertion station 10, the outer parts 14 are continuously fed by means of a laterally disposed first transport or conveyor mechanism 16 and placed in associated holders. The plastic inner parts 15 are duly fed in with the same timing by means of a second transport or conveyor mechanism 17 arranged overhead. The insertion station 10 has an integrated, stationary holding and transfer system with a rod system 12 which can be displaced in the vertical direction by means of a pneumatic cylinder 11, the tip of which is provided with a suction cup 18. As several plastic inner parts 15 are simultaneously placed in associated outer parts 14, several pneumatic cylinders and rod systems arranged one after the other are operated in parallel.

In order to insert the plastic inner parts 15, the outer parts 14 seated in the holders 13 are firstly positioned in the insertion station 10 so that their longitudinal axes essentially coincide with the axis of the rod system. The rod system 12—driven by the pneumatic cylinder 11—then moves, with the exposed suction cup 18, upwards through the outer part 14 from underneath and sucks on the base 32 of a plastic inner part 15 by means of the suction cup 18, pulling the plastic inner part 15 adhered to the suction cup 18 down into the outer part 14 lying underneath. Once the plastic inner part 15 has been inserted sufficiently far down in the outer part 14, the suction cup 18 is released from the base 32 of the plastic inner part 15 and the rod system 12 moves down out of the outer part 14. The plastic inner part 15 is now sitting loosely in the outer part 14 and a section several millimetres in length projects out from the outer part 14, as illustrated in the bottom part of FIG. 5*a*. The plastic inner part 15 is prevented from being pushed any farther down into the outer part 14 because the external diameter of the bead (29 in FIG. 5*a*) is bigger than the smallest internal diameter of the outer part 14. Once the outer part 14 with the loosely inserted plastic inner part 15 is moved on away from the axis of the rod system 12 a new empty outer part 14 takes its place and the insertion process described above starts again.

Figure 3:
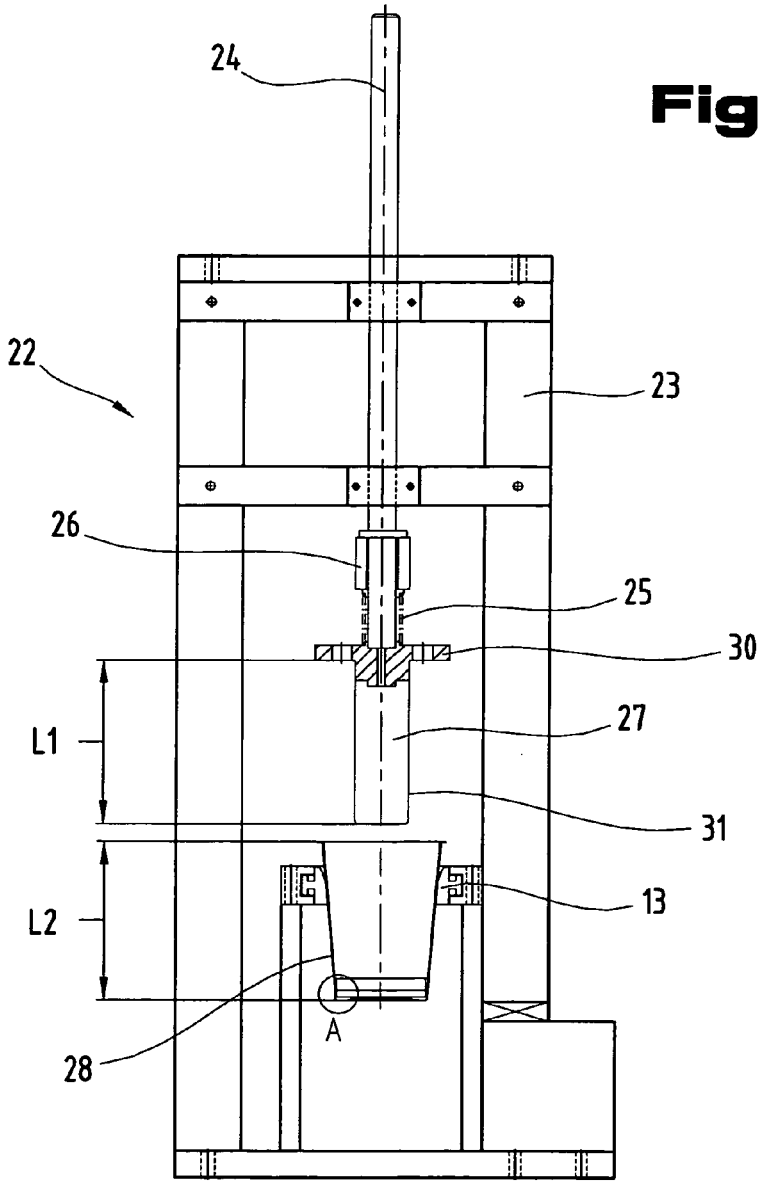
FIG. 3 is a highly simplified side view of an assembly station for pushing in and interlocking the plastic inner part in the outer part in a preferred embodiment of the method proposed by the invention.

The outer parts 14 retained in the holders 13 with the plastic inner parts 15 that were loosely placed in them at the insertion station 10 are conveyed from the insertion station 10 to a downstream assembly station 22, as illustrated in a very simplified format in FIG. 3, showing a side view. At the assembly station 22, the plastic inner part 15 is pushed in so that it interlocks in a special way with the outer part 14 and is securely joined to the outer part 14 to form the desired combination packaging container 28. To this end, the plastic inner part 15 must be pushed down far enough into the outer part 14 so that the bottom edge of the outer part 14 snaps behind the bead 29 of the plastic inner part 15 close to the base, as illustrated in an enlarged detailed view in FIG. 4.

A special ram 27 is used at the assembly station 22 to push in the plastic inner part 15, which is mounted in a frame 23 at the bottom end of a vertically upright and displaceable guide rod 24. The ram 27 is moved by a vertically displaceable driven drive sleeve 26, which concentrically surrounds the guide rod 24 above the ram 27 and acts on the ram 27 via an intermediately disposed spring 25.

The ram 27 itself has a flange-type top part 30 which is placed on the top rim (which may form sealing lip 34) of the plastic inner part 15 and, adjoining it in the pushing direction, a plunger-type bottom part 31 which is placed on the base 32 of the plastic inner part 15 (see also FIGS. 5*a* and *b*). As a result, as the plastic inner part 15 is pushed in, a force is applied to both the base 32 and the top rim (which may form sealing lip 34) of the plastic inner part 15. There is another special feature insofar as the distance L1 between the bottom face of the top part 30 and the bottom face of the bottom part 31 of the ram 27 is grater than the distance L2 between the top rim (which may form sealing lip 34) and the base 32 of the plastic inner part 15 (see FIG. 3). The difference between L1and L2 is preferably a few millimeters. In practice, a distance of approximately 5 mm has proved to be particularly effective.

The difference between the lengths L1 and L2 ensures that when the ram at the assembly station 22 is pushed in, the bottom part 31 is firstly placed on the base so that it collapses outwards or is pushed out (FIG. 5*b*). As the base 32 collapses (is pushed out), the external diameter of the bead 29 is simultaneously reduced so that the plastic inner part 15 can be pushed completely into the outer part 14 with considerably less resistance. This happens as the ram 27 pushes the base 32 farther down by the difference (L1–L2) causing it to collapse outwards and the ram 27 sits with the flange-type top part 30 on the sealing lip 34 of the plastic inner parts 15. The plastic inner part 15 is pushed into the end position with collapsed base 32 illustrated in FIG. 5*c* and the pushing forces are applied simultaneously to the base 32 and the sealing lip 34. This prevents the relatively thin-walled plastic inner part 15 from being deformed as it is pushed in. The intermediately disposed spring 25 prevents too strong forces from being applied to the two parts 14 and 15, preventing the two parts 14 and 15 from buckling.

Figure 4:
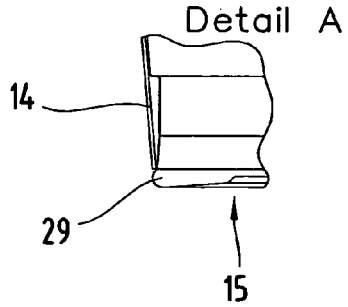
FIG. 4 is a detailed view of the base region of the combination packaging container with the plastic inner part interlocked with the outer part.

Once the plastic inner part 15 reaches the end position, the ram 27 is then pulled back out as the drive sleeve 26 moves upwards, taking the guide rod 24 with it by means of a stop 33. The compressed spring 25 is relaxed and the resiliently collapsed base 32 springs back, whilst the bead 29 resumes its original external diameter, causing the two parts to interlock as illustrated in FIG. 4.

Figure 5:
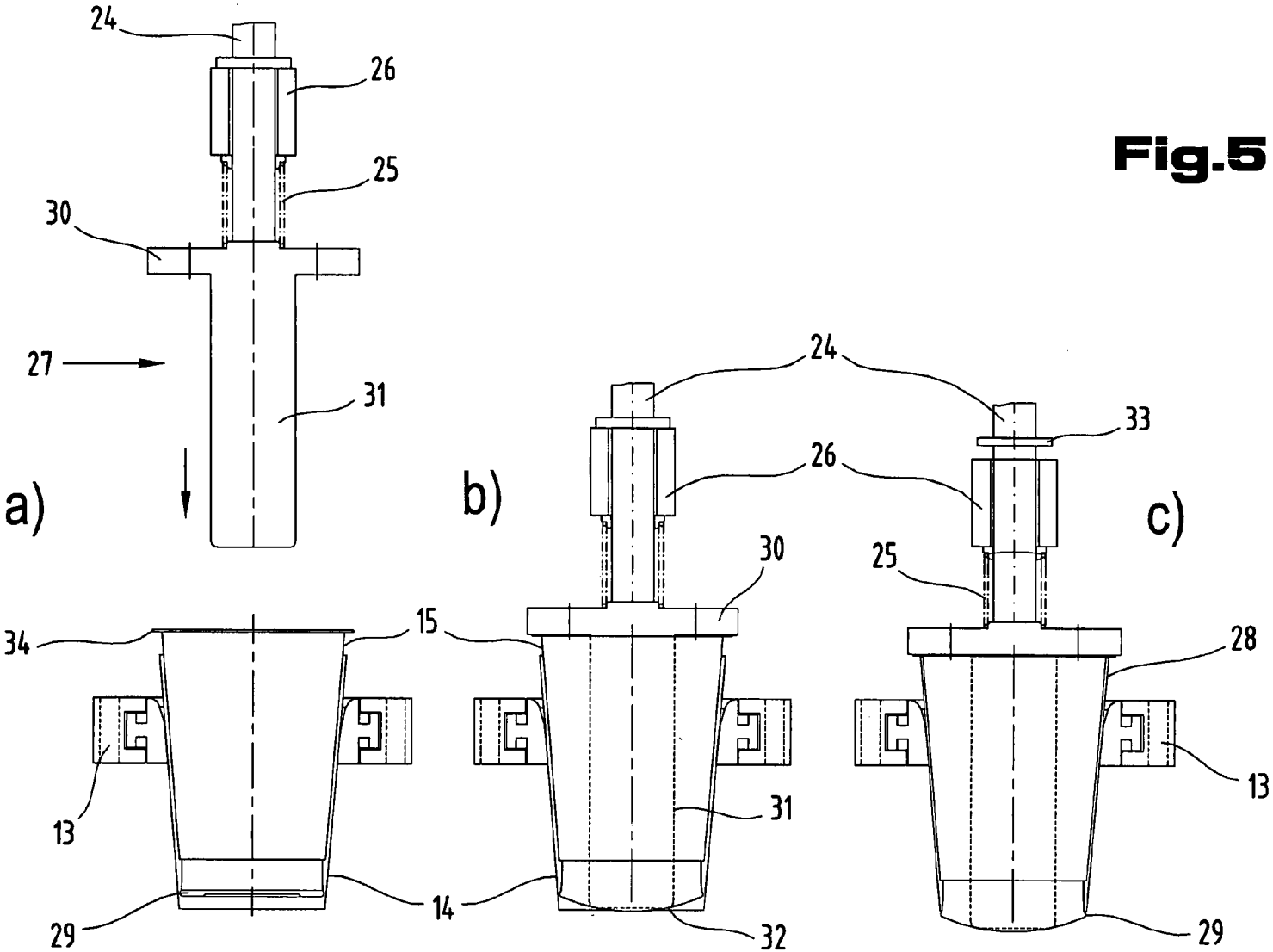
FIG. 5 shows various part-drawings (FIGS. 5*a–c*) illustrating different phases of the pushing-process at the assembly station illustrated in FIG. 3.

To ensure that the two parts 14 and 15 are pushed inside one another and interlocked without giving rise to problems, the pushing-in process illustrated in FIG. 5, whereby the base 32 of the plastic inner part 15 is pushed out, may also advantageously be carried out as part of a different process sequence, which to a certain extent is a "kinematic reverse" of the procedure illustrated in FIG. 5. In this case, the plastic inner part 15 is clinched over a matching mandrel and the outer part 14 is then pushed over it, causing the base 32 of the plastic inner part 15 to collapse outwards. This can advantageously be achieved by providing the mandrel with an extractable cambered base plate, which pushes the base 32 outwards. The outer part 14 is pushed over the plastic inner part 15 seated on the mandrel and interlocked with it. The extractable base plate on the mandrel ensures that the base 32 of the plastic inner part 15 collapses outwards during the process, which facilitates and in fact makes the joining process possible.

All in all, the invention proposes a method and a device for producing a combination packaging container, which is distinctive due to the following characteristic properties:

- when assembling the plastic inner part and cardboard outer part, the base of the plastic inner part is firstly pushed out so that the bead on the plastic inner part can be compressed by the outer part without being damaged;
- the ram simultaneously pushes on the sealing lip of the plastic inner part; this prevents the plastic inner part from being deformed during the assembly process; the entire ram mechanism is spring-mounted, in order to prevent any buckling of the outer part and plastic inner part.

Naturally, it would also be possible to operate the process of joining the plastic inner part 15 to the outer part 14 described above in any axial direction other than the relative vertical arrangement described and illustrated here. In the case of the system illustrated in FIGS. 1 to 5 and the described method associated with it, the plastic inner part 15 is always positioned or aligned in the position it will later assume during use where the base 32 is always the lowest region of the combination packaging container 28.

As already described above, the outer part 14 is held in an appropriate holder 13 for the purposes of the invention and the plastic inner part 15 is introduced into the outer part 14 retained on the holder 13 and then pushed into the outer part in an interlocking arrangement. Both the process of pre-positioning the plastic inner part 15 inside the outer part 14 and the subsequent process whereby the plastic inner part 15 is pushed in or assembled with the outer part 14 may be operated at a single station and indeed at the split assembly station mentioned above, namely the insertion station 10 and assembly station 22. This will depend on which process sequence is selected and what timing can be obtained for the purpose of final assembly as a result. Naturally, however, if using a non-separated insertion and assembly station, it would also be possible to operate several of them simultaneously adjacent to or parallel with one another in order to increase output.

Figure 6:
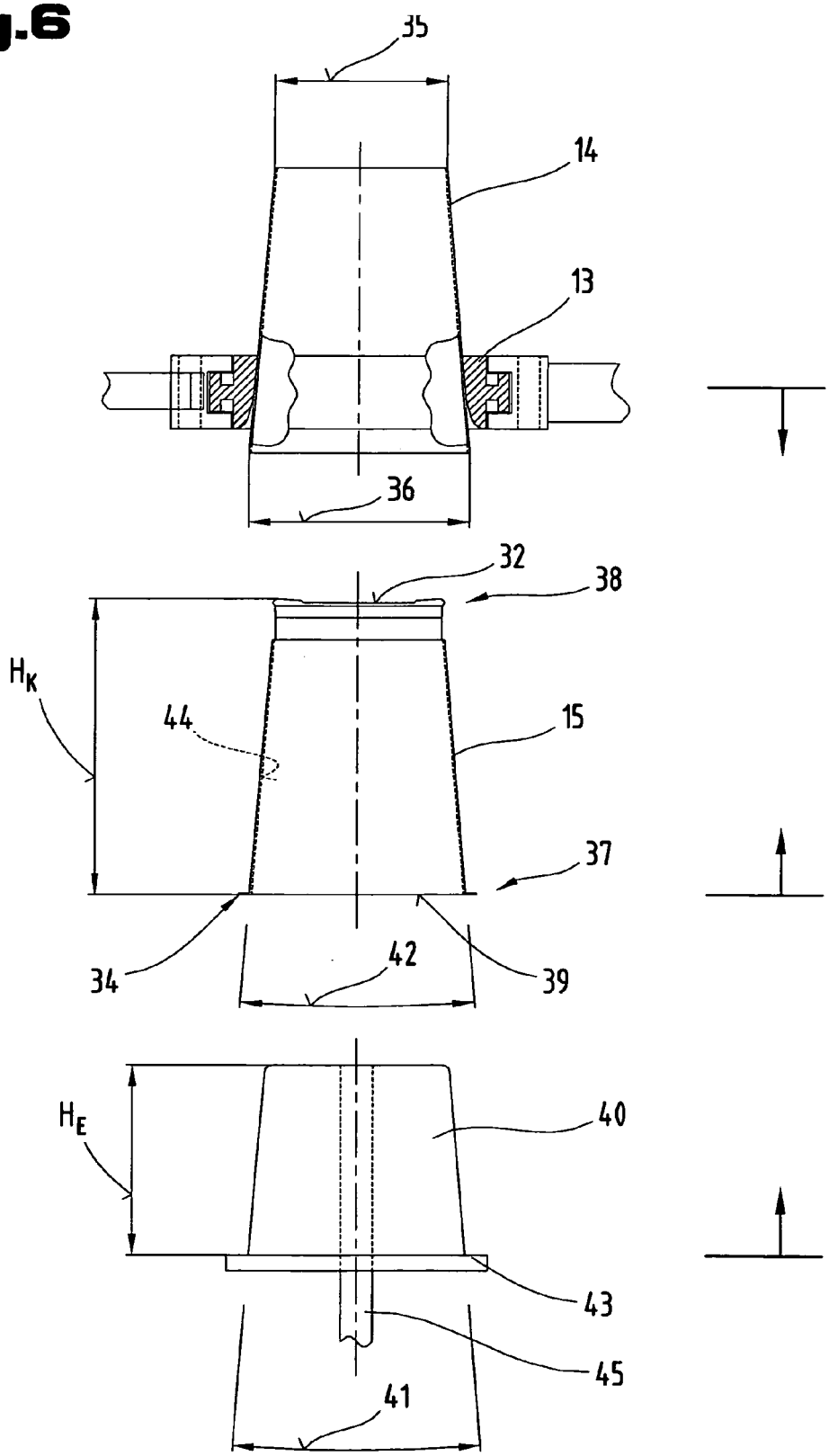
FIG. 6 is a simplified schematic diagram depicting a side view of another possible assembly station, viewed in partial section.
Figure 7:
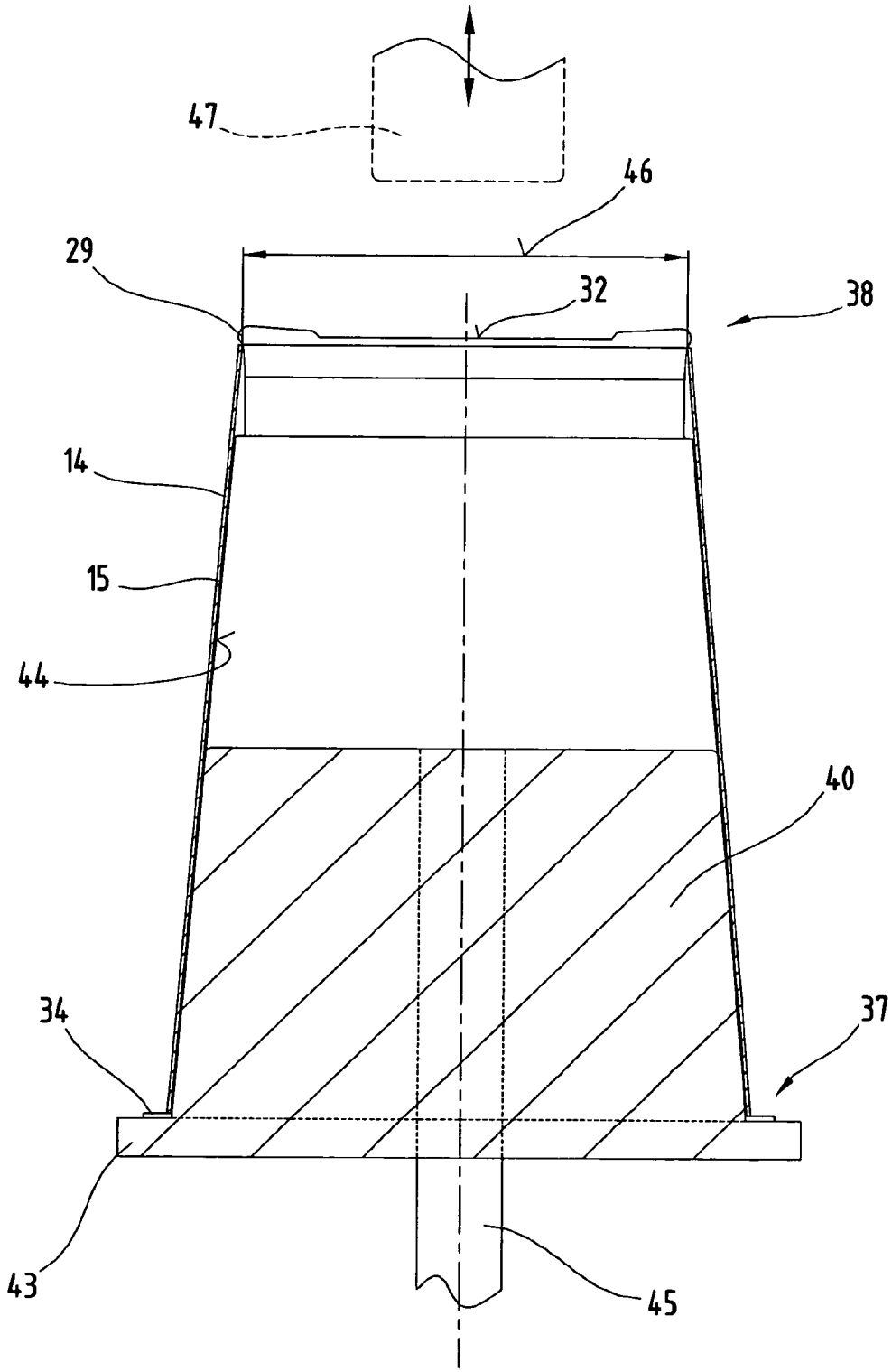
FIG. 7 is a simplified schematic diagram on an enlarged scale, showing a side view of the assembled combination packaging container illustrated in FIG. 6 in the finished state.

FIGS. 6 and 7 illustrate another possible solution proposed by the invention, constituting an independent solution in its own right, for joining the two pre-fabricated elements, namely the plastic inner part 15 and the outer part 14, the same reference numbers and component names as those used in FIGS. 1 to 5 above being used here. To avoid unnecessary repetition, reference should be made to the more detailed description of FIGS. 1 to 5 given above. As illustrated in a very simplified format, both the pre-positioning of the plastic inner part 15 in the outer part 14 and the final assembly process—in other words pushing the outer part 14 fully down—are operated in a single assembly station. As an alternative to this approach, however, it would also be possible, as mentioned above in the description relating to FIGS. 1 to 5, to provide an additional pre-positioning station upstream of the final assembly station, at which the plastic inner part 15 is introduced into the outer part 14, and then feed them in the position in which they are not yet interlocked to the station at which the pushing-in and interlocking process takes place. These arrangements have not been illustrated in an endeavour to retain clarity in the drawings.

By contrast with the embodiments described and illustrated above, the outer part 14 is still retained on the separate holder 13 in this case but the outer part 14 with its smaller dimension 35, which has an external casing in the form of a truncated cone, is arranged above as viewed in the vertical direction and is retained with its bigger bottom dimension 36 positioned downwards in the holder 13.

Unlike the previously described process sequence and the schematically illustrated assembly plant where the outer part 14 is automatically retained in the holder 13 of its own accord, requiring no additional aid due to its geometric shape and the differing smaller and larger dimensions 35, 36, in this case, because the outer part 14 is arranged in exactly the reverse position—and the same of course applies with respect to the design of the holder 13—it may be necessary to provide additional retaining means, not illustrated here, in order to hold the outer part 14 relative to the holder 13. These retaining means may be vacuum slots, suction cups, mechanical stops or such like, for example.

The plastic inner part 15 in FIG. 6 is also illustrated in a position or disposition in which the base 32, as viewed in the vertical direction, is the region of the plastic inner part 15 in the highest position, in other words at the top. In the case of this process sequence of the assembly, illustrated in a simplified format, both the plastic inner part 15 and the outer part 14 are conical, tapering towards the base 32, and the plastic inner part 15, as viewed in the vertical direction, is inserted in the outer part 14 retained in the holder 13 from underneath.

To interlock or retain it in outer part 14 retained on the holder 13, the plastic inner part 15 has catch means 37, 38 and in the embodiment illustrated as an example here, the first catch means 37 is disposed or provided in the region of an open end face 39 of the plastic inner part 15 and the other catch means 38 in the region of the base 32. Consequently, the first catch means 37 may be the sealing lip 34, in a manner known per se. The other catch means 38 in the region of the base 32 may be provided in the form of a bead 29 extending in at least certain regions around the periphery of the plastic inner part 15, but which may also be provided so that it extends continuously around the entire circumference of the plastic inner part. If the other catch means 38 or the bead 29 is provided in only certain regions around the circumference of the plastic inner part 15, any condensate which might have formed in this region due to a change in temperature or an abrupt change in temperature occurring between the outer part 14 and the plastic inner part 15, for example, can drain out or be removed unhindered, so that the outer part 14 will have a longer shelf without adverse effects.

As already explained in the description above, the outer part 14 is retained in the holder 13 and the plastic inner part 15 is inserted or introduced in the same relative axial direction, after which the plastic inner part 15 is joined by the catch means 37, 38 to the outer part 14 to produce the combination packaging container 28. In addition, however, it would also be possible, simultaneously with the motion of pushing the plastic inner part 15 into the outer part 14 retained on the holder 13, for the outer part 14 to be moved in the opposite direction to the direction in which plastic inner part 15 is moved. As a result of this combined motion, the final assembly process is not achieved by moving the plastic inner part 15 over the entire displacement path but by the combined and opposite motion of the outer part 14 relative to the plastic inner part 15, which means that this travel is shortened or divided and the requisite displacement paths can be covered in the same time at a lower displacement speed in absolute terms. This additional motion of the outer part 14 towards the plastic inner part 15 could naturally also be operated at the insertion station 10 connected to the assembly station 22 described in relation to FIGS. 1 to 5, both during separate assembly and also at the combined insertion and assembly station.

In this process sequence illustrated in simplified format in FIG. 6, an inserting element 40, illustrated very diagrammatically, is provided for the plastic inner part 15, which has an external angle 41 in the region of its outer casing which corresponds almost exactly to an inner conical angle 42 of the plastic inner part 15. However, a cross section or diameter of the inserting element 40 is also adapted to the internal dimensions of the plastic inner part 1, in the region of the open end face 39 through to the end of the inserting element 40, so that the inserting element 40 can be inserted or introduced far enough into the plastic inner part 15 so that the sealing lip 34 of the plastic inner part 15 sits on a support element 43 provided on the inserting element 40. Simultaneously, however, the relatively thin wall of the plastic inner part 15 also sits on the inserting element 40, as is most clearly illustrated in FIG. 7. Also illustrated in FIG. 7 is the plastic inner part 15 fully interlocked on the outer part 14, with the inserting element 40 still disposed entirely in the interior 44 formed by the plastic inner part 15.

As may also be seen in a simplified format by looking at FIGS. 6 and 7 together, at least one suction line 45 is provided inside the inserting element 40, which opens into the free space or intermediate space left between the base 32 of the plastic inner part 15 and the inserting element 40. This being the case, a length or height $H_K$ of the plastic inner part 15, as measured in the direction of the longitudinal axis, between the base 32 and the open end face 39 is longer than a length or height $H_E$ of the inserting element 40. As a result of the dimensional difference or difference in size of the inserting element 40 relative to the plastic inner part 15 described above, a vacuum pressure can be generated via the suction line 45 because the height or length of the plastic inner part and the inserting element 40 are different, as described above. Consequently, the inserting element 40 projects from the sealing lip 34 only partially in the direction towards the base 32. This causes a reduction in the outer periphery of the catch means 38, enabling the plastic inner part 15 to be ultimately interlocked with or pushed beyond the region of the other catch means 38 due to the smaller dimension 35 of the outer part 14.

As illustrated in FIGS. 1 to 5 above, this is achieved due to the fact that the base 32 resiliently collapses outwards in a specific manner during the insertion process as the insertion force is applied to it, in other words deformed at the side remote from the interior 44. This reduction of the outer periphery or cross section of the other catch means 38 is brought about by a predefinable deformation of the plastic inner part 15 in the region of its base 32 until the outer periphery or the external dimension or cross section more or less corresponds to an internal diameter 46 of the outer part 14 in the region of its smaller dimension 35.

In the case of the embodiment illustrated in FIGS. 6 and 7, unlike the one described with respect to FIGS. 1 to 5, the base 32 collapses inwards, not at the side remote from the interior 44 but by a force resiliently acting on it in a predefined manner in the direction towards the interior 44 of the plastic inner part. This inward collapse and the associated reduction in the cross-sectional dimension of the periphery of the other catch means 38 can be produced by generating a vacuum pressure via the suction line 45 and the vacuum generator, not illustrated, which might be provided in the form of vacuum pumps, for example. As an alternative to this approach, however, it would also be possible to generate this force acting on it by means of a thrust die 47, as schematically illustrated in a simplified format in FIG. 7. This being the case, the force may be applied either by generating the vacuum pressure via the suction line 45 or by means of the thrust die 47 alone, or alternatively by a combination of these two process sequences.

If the plastic inner part 15 is a relatively thin-walled part, for example, the deformation force applied to the base 32 may be generated exclusively by means of the vacuum pressure generated in the interior 44. If the plastic inner part 15 has thicker wall parts, it can be deformed either by means of the thrust die 47 alone or alternatively and in order to fix the position of the plastic inner part 15 more securely on the inserting element 40, by using a combined application.

Figure 8:
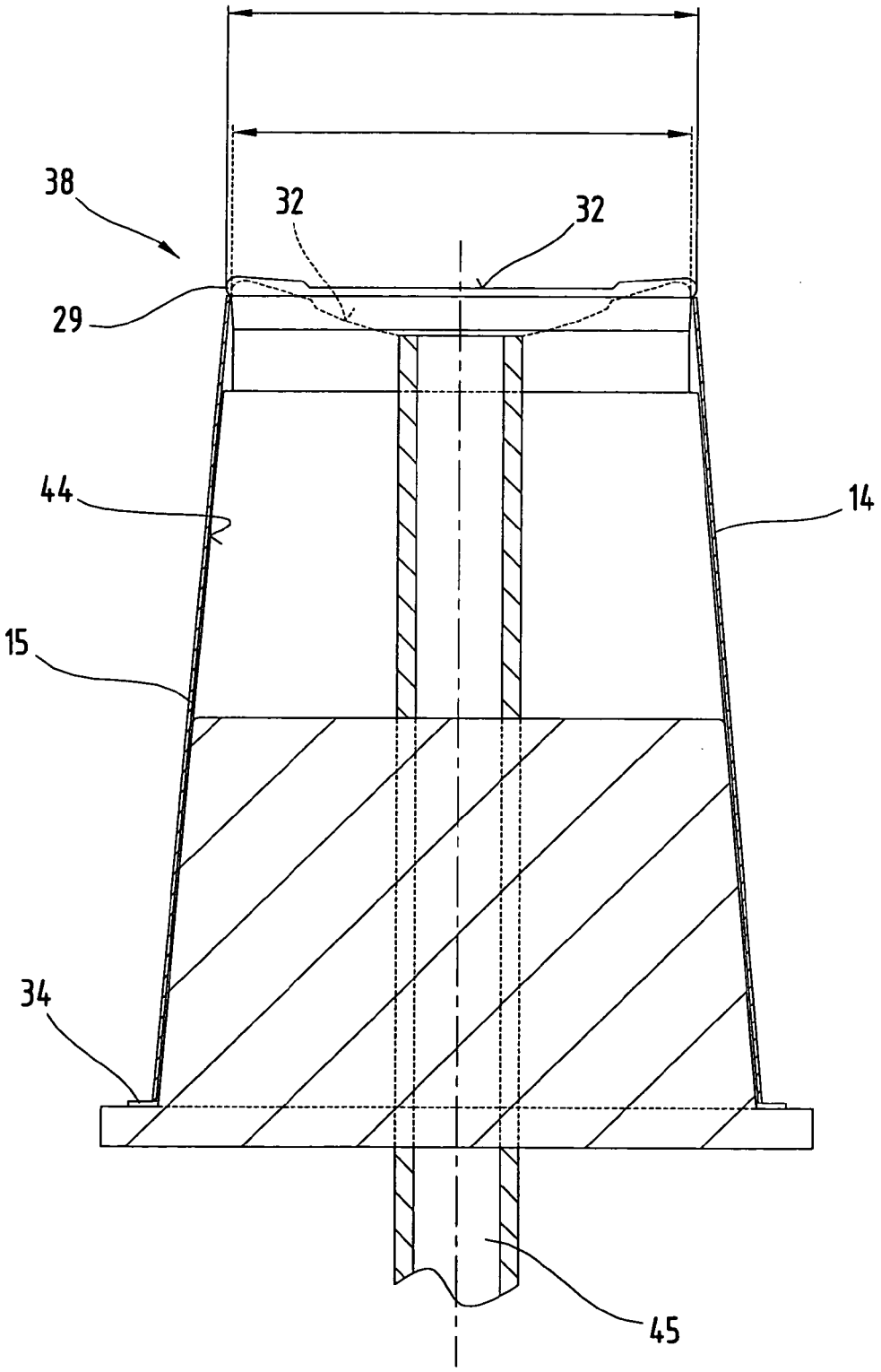
FIG. 8 is a simplified schematic diagram on an enlarged scale, showing a side view in section of another possible embodiment of the assembly station illustrated in FIGS. 6 and 7.

In FIG. 8, similarly to FIG. 7, the schematically illustrated suction line 45 is provided but in this cases extends as far as the vicinity of the base 32*t*. Consequently, depending on the distance selected between the end of the suction line 45 and the base 32, the latter can be deformed in a specifically predefined manner. Accordingly, the distance may be between a few millimetres, e.g. 2 to 6 mm, right up to the centimetre range, e.g. 1.0 to 1.5 cm or more. When generating the vacuum pressure, suction is initially applied in the entire interior 44 and when the base 32 has deformed accordingly it will move towards the suction line 45 and be sucked onto it so that it can be held in a fixed position. The suction line 45 therefore acts as a suction cup. This enables the reduction in the external periphery or cross section of the other catch means 38 to be obtained as described above, in con-operation with the base 32, followed by interlocking action of the other catch means 38 behind the edge of the outer part 14 in the region of its smaller dimension 35, as described above. Again, this enables the position of the outer part 14 to be fixed between the two catch means 37, 38.

The base 32 collapsed inwards towards the interior 44 is schematically indicated by broken lines and an attempt has also been made to show the situation where a plastic inner part 15 of a rounded design has another catch means 38—in this particular case the bead 29—which is reduced in dimension as a result.

At this stage, it should be pointed out that the approach using the inward collapse of the base 32 towards the interior 44 illustrated here could also be used with the machinery described in relation to FIGS. 1 to 5, in which case the orientation of the outer parts 14 and plastic inner part 15 would be that of the normal position of usage. Similarly, however, the arrangement and orientation of the outer part 14 and plastic inner part 15 could be as in FIGS. 6 to 8 rotated by 180°—in other words correspond to the standard position of usage.

In order to prevent the outer part 14, which is usually made from recycled cardboard, from coming loose from or undesirably swelling on the plastic inner part 15, it has been found to be of advantage if a moisture-absorbing or adhesive layer is provided on the side of the outer part 14 facing the plastic inner part 15, at least in certain regions, which might be provided in the form of a hydro-gel or similar, for example. This hydro-gel would also serve as a means of absorbing or taking up any condensation which might form or any water formed due to sweating if a difference in temperature occurs between the medium with which the interior 44 is charged or filled, for example yoghurt etc., and the external environment, without adversely affecting the material of the outer part 14. The absorption of moisture can cause the cardboard material to swell, in which case the two catch means 37, 38 will no longer be completely interlocked, undesirably causing the outer part 14 to work loose from the plastic inner part 15. This working loose simultaneously causes a deterioration in the supporting function afforded by the outer part 14 to the plastic inner part 15, which is then partially or totally lost.

For the sake of good order, it should finally be pointed out that in order to provide a clearer understanding of the structure of the combination packaging container, it and its constituent parts have been illustrated to a certain extent out of proportion and/or on an enlarged scale and/or on a reduced scale.

The independent solutions proposed by the invention to the set objective may be found in the description.

Figure 2:
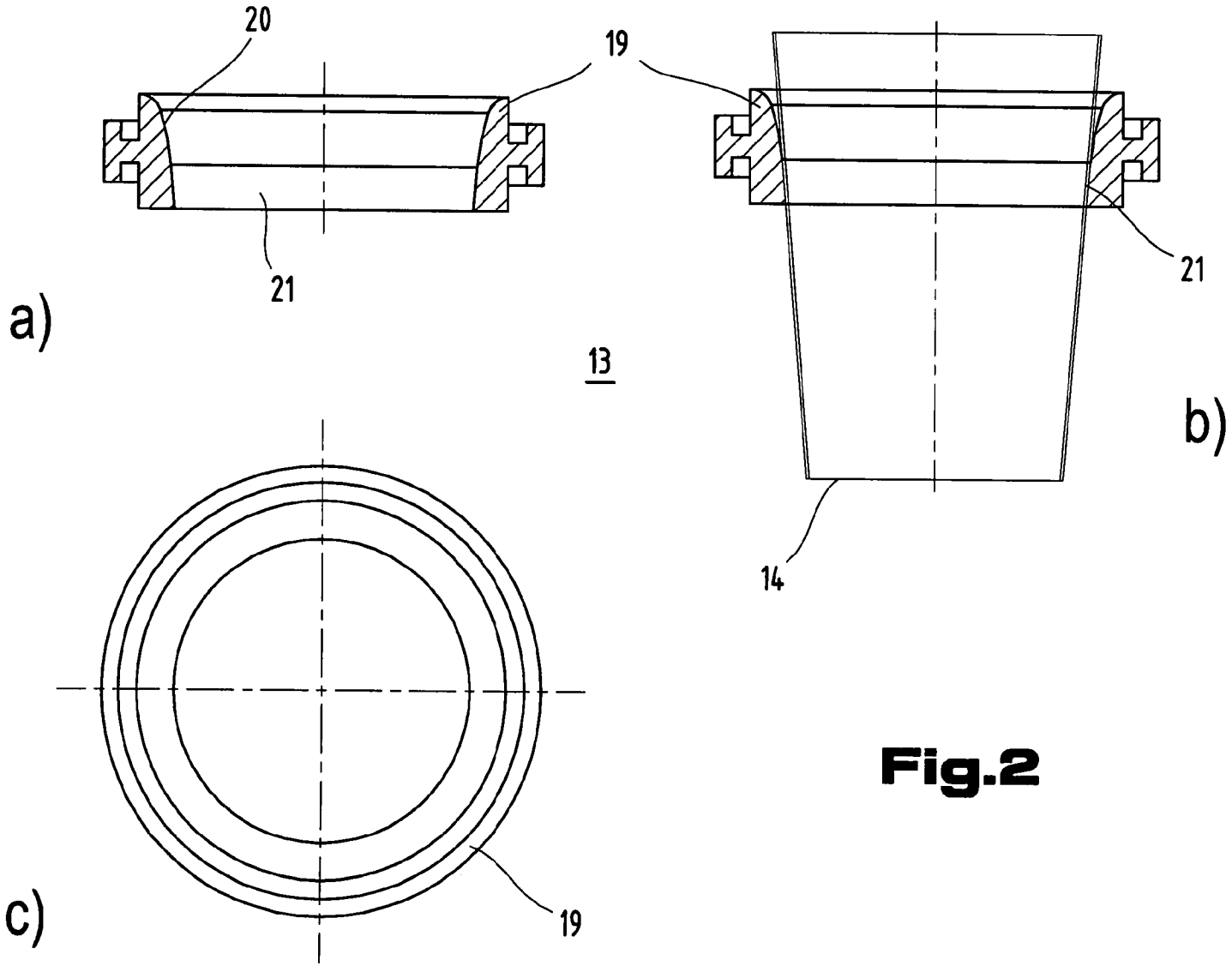
FIG. 2 shows various part-drawings (FIGS. 2*a–c*) giving different views of a retaining ring for the holder illustrated in FIG. 1.

Above all, the subject matter of the individual embodiments illustrated in FIGS. 1; 2; 3, 4; 5; 6, 7; 8 may be construed as independent solutions proposed by the invention. The associated objectives and solutions proposed by the invention may be found in the detailed descriptions of these drawings.

LIST OF REFERENCE NUMERALS

10 Insertion station
11 Pneumatic cylinder
12 Rod system
13 Holder
14 Outer part
15 Plastic inner part
16 Transport and conveyor mechanism
17 Transport and conveyor mechanism
18 Suction cup
19 Retaining ring
20 Internal contour
21 Bottom section
22 Assembly station
23 Frame
24 Guide rod
25 Spring
26 Drive sleeve
27 Ram
28 Combination packaging container
29 Bead
30 Top part
31 Bottom part
32 Base
33 Stop
34 Sealing lip
L1 Distance
L2 Distance
35 Smaller dimension
36 Larger dimension
37 Catch means
38 Catch means
39 End face
40 Inserting element
41 External angle
42 Conical angle
43 Support element
44 Interior
45 Suction line
46 Internal diameter
47 Thrust die The inventioned claimed is:

1. Method of producing a combination packaging container comprising a beaker-shaped plastic inner part having a base and a casing-type outer part surrounding the plastic inner part and retained on the external face of the plastic inner part in an interlocking arrangement, by which method the two parts are pushed one inside the other in the interlocking arrangement, the outer part is retained in a holder, the plastic inner part is introduced into the outer part retained in the holder and then pushed down into the outer part so as to interlock, a first catch means being provided in the region of an open end face of the plastic inner part and a second catch means being provided in the region of the base to interlock the plastic inner part and the outer part, and before and during the process of pushing the plastic inner part into the outer part, the second catch means is reduced by means of a predefinable deformation of the base to a degree so that it corresponds more or less to an internal diameter of the outer part in the region of a smaller dimension and can therefore be pushed completely into the outer part while meeting a significantly reduced amount of resistance.

2. Method as claimed in claim 1, wherein the plastic inner part is loosely inserted in the outer part retained in the holder at an insertion station and the loosely inserted plastic inner part is pushed into and interlocked with the outer part at an assembly station.

3. Method as claimed in claim 2, wherein when the plastic inner part is pushed in at the assembly station, a force is simultaneously applied to the plastic inner part in the pushing-in direction at its top rim and in the region of the base.

4. Method as claimed in claim 1, wherein the plastic inner part is pushed into the outer part at the same station at which the plastic inner part is inserted in the outer part.

5. Method as claimed in claim 1 wherein, simultaneously with the motion by which the plastic inner part is inserted in the outer part retained in the holder, the outer part is displaced towards the plastic inner part in the opposite direction relative to the direction of motion of the plastic inner part.

6. Method as claimed in claim 1, wherein the plastic inner part and the outer part are conical, tapering towards the base and the plastic inner part is inserted in the outer part from above.

7. Method as claimed in claim 1, wherein the base of the plastic inner part is essentially flat and the plastic inner part is loosely inserted in the outer part and retained by the base.

8. Method as claimed in claim 7, wherein the plastic inner part is releasably retained by means of a holding mechanism, extending through the outer part from underneath, by the external face of the base and is pulled into the outer part.

9. Method as claimed in claim 8, characterised in that the holding mechanism releasably retains the plastic inner part by means of a suction cup.

10. Method as claimed in claim 1, wherein the first catch means is provided by a sealing lip.

11. Method as claimed in claim 1, wherein the base resiliently collapses outwards due to the pushing force acting on it during the pushing-in process.

12. Method as claimed in claim 1, wherein the base resiliently collapses inwards in a predefined manner towards an interior of the plastic inner part due to a force acting on it during the pushing in process.

13. Method as claimed in claim 12, wherein the force acting on it is generated by a separate thrust die (47).

14. Method as claimed in claim 12, wherein the force acting on it is produced by generating a vacuum pressure in the region of the interior of the plastic inner part.

15. Method of producing a combination packaging container comprising a beaker-shaped plastic inner part having a base and a casing-type outer part surrounding the plastic inner part and retained on the external face of the plastic inner part in an interlocking arrangement, by which method the two parts are pushed one inside the other in the interlocking arrangement, the outer part is retained in a holder with a bigger internal dimension disposed at the bottom, the plastic inner part is introduced into the outer part retained in the holder and then pushed down into the outer part so as to interlock.

16. Method as claimed in claim 15, wherein catch means are provided on the plastic inner part in order to retain or interlock the plastic inner part and outer part.

17. Method as claimed in claim 16, wherein the second catch means is a bead extending at least in certain regions around the circumference of the plastic inner part.

18. Method as claimed in claim 17, wherein the bead extends continuously around the circumference of the plastic inner part.

19. Method as claimed in claim 15, wherein the plastic inner part and outer part are conical, tapering in the direction towards the base, and the plastic inner part is inserted in the outer part from underneath.

20. System for implementing a method of producing a combination packaging container comprising a beaker-shaped plastic inner part having a base and a casing-type outer part surrounding the plastic inner part and retained on the external face of the plastic inner part in an interlocking arrangement, by which method the two parts are pushed one inside the other in the interlocking arrangement, the system comprising a holder retaining the outer part, an assembly station for inserting and interlocking the plastic inner part in the outer part retained in the holder, the plastic inner part and the outer part are of a conical design, tapering towards the bottom, the holder has a retaining ring with a conical internal contour tapering towards the bottom, in which the outer part is held clamped, and a bottom section of the internal contour of the retaining ring matches the conically tapered shape of the outer part and the diameter of the internal contour above the bottom section becomes increasingly wide.

21. System as claimed in claim 20, wherein the retaining ring is made from a dimensionally stable material with a low sliding friction.

22. System as claimed in claim 20, wherein the assembly station has a ram mounted so as to slide in the pushing-in direction, and to apply a force acting in the pushing-in direction in order to push in and interlock the plastic inner part in the outer part.

23. System as claimed in claim 22, wherein the ram in the assembly station is moved in the pushing-in direction by means of a displaceable drive means and the drive means engages with the ram via a spring.

24. System as claimed in claim 20, wherein the insertion station is connected upstream of the assembly station, at which the plastic inner part is loosely inserted in the outer part retained in the holder (13).

25. System as claimed in claim 24, wherein the insertion station has holding and conveying means, which releasably hold the plastic inner part whilst the outer part retained in the holder is conveyed by a transport and conveyor mechanism.

26. System as claimed in claim 25, wherein the holding and conveying means has a suction cup and the transport and conveyor mechanism has a rod system which extends through the outer part retained in the holder and is displaceable in the pushing-in direction by means of a pneumatic cylinder.

27. System as claimed in claim 20, wherein the plastic inner part and the outer part are conical, tapering towards the base, and the holder has a retaining ring with a conically tapered internal contour, the taper as viewed in the vertical direction converging at the top.

28. System as claimed in claim 20, wherein the holder for retaining the outer part is provided with retaining means.

29. System as claimed in claim 20, wherein the plastic inner part is provided with an inserting element for inserting and/or pushing in the outer part, which partially projects into the interior of the plastic inner part.

30. System as claimed in claim 29, wherein the cross section of the inserting element matches the internal dimensions of the plastic inner part.

31. System for implementing a method of producing a combination packaging container comprising a beaker-shaped plastic inner part having a base and a casing-type outer part surrounding the plastic inner part and retained on the external face of the plastic inner part in an interlocking arrangement, by which method the two parts are pushed one inside the other in the interlocking arrangement, the system comprising a holder for retaining the outer part, an assembly station for inserting and interlocking the plastic inner part in the outer part retained in the holder, the assembly station has a ram mounted so as to slide in a pushing-in direction and to apply a force acting in the pushing-in direction in order to push in and interlock the plastic inner part in the outer part, the ram being designed so that, during the pushing-in process, a force is applied both to the base and to a top rim of the plastic inner part.

32. System as claimed in claim 31, wherein the ram has a flange-type top part which is placed on the top rim of the plastic inner part and is adjoined in the pushing-in direction by a plunger-type bottom part which is placed on the base of the plastic inner part.

33. System for implementing a method of producing a combination packaging container comprising a beaker-shaped plastic inner part having a base and a casing-type outer part surrounding the plastic inner part and retained on the external face of the plastic inner part in an interlocking arrangement, by which method the two parts are pushed one inside the other in the interlocking arrangement, the system comprising a holder for retaining the outer part, an assembly station for inserting and interlocking the plastic inner part in the outer part retained in the holder, the assembly station has a ram mounted so as to slide in a pushing-in direction and to apply a force acting in the pushing-in direction in order to push in and interlock the plastic inner part in the outer part, the ram has a flange-type top part which is placed on a top rim of the plastic inner part and is adjoined in the pushing-in direction by a plunger-type bottom part which is placed on the base of the plastic inner part, and the distance between a bottom face of the top part and a bottom face of the ram is a few millimeters bigger than the distance between the top rim and the base of the plastic inner part.

34. System for implementing a method of producing a combination packaging container comprising a beaker-shaped plastic inner part having a base and a casing-type outer part surrounding the plastic inner part and retained on the external face of the plastic inner part in an interlocking arrangement, by which method the two parts are pushed one inside the other in the interlocking arrangement, the system comprising a holder for retaining the outer part, an assembly stationfor inserting and interlocking the plastic inner part in the outer part retained in the holder, the plastic inner part and the outer part are conical, tapering towards the base, the holder has a retaining ring with a conically tapered internal contour, the taper as viewed in a vertical direction converging at the top, and a top portion of the internal contour of the retaining ring matching the conically tapered shape of the outer part and the diameter of the internal contour below the top portion becoming increasingly wide.

35. System for implementing a method of producing a combination packaging container comprising a beaker-shaped plastic inner part having a base and a casing-type outer part surrounding the plastic inner part and retained on the external face of the plastic inner part in an interlocking arrangement, by which method the two parts are pushed one inside the other in the interlocking arrangement, the system comprising a holder for retaining the outer part, an assembly station for inserting and interlocking the plastic inner part in the outer part retained in the holder, the plastic inner part is provided with an inserting element for inserting and/or pushing into the cuter part, the inserting element partially projecting into the interior of the plastic inner part, the outer part is held clamped, and at least one suction line in the inserting element, which opens into a free intermediate space left between the base of the plastic inner part and the inserting element.

36. System as claimed in claim 35, wherein the suction line is connected to a vacuum generator.

37. System as claimed in claim 35, wherein the suction line projects beyond the inserting element and extends to a predefinable distance short of the base of the plastic inner part.

* * * * *